US011419461B1

(12) United States Patent
Papageorge et al.

(10) Patent No.: US 11,419,461 B1
(45) Date of Patent: Aug. 23, 2022

(54) BODY SCRUBBING APPLIANCE FOR USE WITH LOOFAHS

(71) Applicants: Nicholas Steve Papageorge, Tampa, FL (US); Peter Steve Papageorge, Port Richey, FL (US)

(72) Inventors: Nicholas Steve Papageorge, Tampa, FL (US); Peter Steve Papageorge, Port Richey, FL (US)

(73) Assignees: Nicholas S Papageorge, Port Richey, FL (US); Peter S Papageorge, Port Richey, FL (US)

( * ) Notice: Subject to any disclaimer, the term of this patent is extended or adjusted under 35 U.S.C. 154(b) by 343 days.

(21) Appl. No.: 16/868,280

(22) Filed: May 6, 2020

Related U.S. Application Data

(60) Provisional application No. 62/843,837, filed on May 6, 2019.

(51) Int. Cl.

| | |
|---|---|
| ***A47K 7/02*** | (2006.01) |
| ***B25G 1/10*** | (2006.01) |
| ***B25G 1/04*** | (2006.01) |
| ***B25G 3/18*** | (2006.01) |

(52) U.S. Cl.
CPC ..... *A47K 7/028* (2013.01); *B25G 1/10* (2013.01); *B25G 1/04* (2013.01)

(58) Field of Classification Search
CPC . A47K 7/028; A47K 7/00; A47K 7/02; A47K 7/022; A47K 7/024; A47K 7/026; A47K 7/06; B25G 1/10; B25G 1/04; B25G 1/00; B25G 1/06; B25G 1/102; B25G 3/00; B25G 3/14; B25G 3/18
USPC .... 15/209.1, 142, 147.2, 229.11, 145, 147.1, 15/208, 229.13, 244.3, 244.4; 401/48, 6, 401/11
See application file for complete search history.

(56) References Cited

U.S. PATENT DOCUMENTS

| | | | | |
|---|---|---|---|---|
| 5,386,609 | A | 2/1995 | Xenos | |
| 5,490,302 | A | 2/1996 | Dion | |
| 5,673,455 | A | 10/1997 | Per-Lee et al. | |
| 6,276,022 | B1 * | 8/2001 | Gallacher | A47K 7/028 15/147.2 |
| D452,046 | S | 12/2001 | Borcherds et al. | |
| 6,616,364 | B2 | 9/2003 | Katz et al. | |
| 6,983,866 | B2 | 1/2006 | Smart et al. | |
| 7,469,442 | B1 * | 12/2008 | Matheson | A47K 7/02 15/209.1 |
| 7,503,715 | B2 | 3/2009 | Khubani | |
| 8,631,523 | B1 | 1/2014 | Schneider et al. | |
| 8,677,546 | B1 | 3/2014 | Kholodny et al. | |
| 8,869,341 | B2 | 10/2014 | Bayham | |
| 9,212,039 | B1 | 12/2015 | Reidy et al. | |
| 9,713,404 | B2 | 7/2017 | Hessler | |
| 9,993,121 | B1 | 6/2018 | Chang | |

(Continued)

*Primary Examiner* — David J Walczak

(57) ABSTRACT

A body scrubbing appliance adapted for detachably holding a variety of different loofahs having ropes of varying lengths. The body scrubbing appliance includes a handle including a channel, a loofah support including a loofah holder and support stem where the support stem moves axially within the channel, via a compression spring, when excessive force is applied to the loofah holder to provide comfort when washing and scrubbing a person's body. The handle includes a series of protrusions for releasably attaching ropes of different loofahs to securely retain loofahs within the loofah holder of the appliance.

20 Claims, 10 Drawing Sheets

(56) References Cited

U.S. PATENT DOCUMENTS

| | | | | |
|---|---|---|---|---|
| 2003/0000039 | A1 | 1/2003 | Borcherds | |
| 2005/0074272 | A1* | 4/2005 | Sorrell | A47K 7/03 401/196 |
| 2008/0205963 | A1 | 8/2008 | Schmidig | |
| 2012/0204372 | A1 | 8/2012 | Kelly et al. | |

* cited by examiner

BODY SCRUBBING APPLIANCE FOR USE WITH LOOFAHS

CROSS-REFERENCE TO RELATED APPLICATIONS

This application claims the benefit of U.S. Provisional Patent Application Ser. No. 62/843,837 filed on May 6, 2019, which is incorporated by reference herein in its entirety.

FIELD OF THE INVENTION

The present invention relates to hygiene appliances, and more particularly, to a body scrubbing appliance adopted for use with a variety of different loofahs having rope handles of different lengths, to wash and scrub various body parts of a person when bathing or showering.

BACKGROUND OF THE INVENTION

Individuals often enjoy soaking in a hot bath, or like to take long showers and stand under hot running water, to relax various muscles of the body and relieve tension while preparing to wash various parts of the body. Common hygiene practices generally involve applying soap or a liquid gel to a sponge or wash towel typically held in a person's hand and used to wash and scrub frontal areas of the body. In practice, the sponge and towel often slips or falls off the individual's hand during use and into the bathtub, or on the floor of the shower. Another common device that is also used for washing includes a loofah. A loofah generally comprises a nylon mesh bundle having numerous openings, and a rope handle that is attached to the mesh bundle. Soap or liquid gel is applied to the mesh bundle to penetrate within the openings of the mesh. The constructional features of the mesh bundle also provide a friction scrubbing element when washing and scrubbing body parts of a person. During use, individuals often insert a hand through the looped rope handle to prevent the loofah from falling, a tactic similar to soap on a rope. As such, the looped rope not only helps retain the loofah to the user, but is also used to hang the loofah for drying and storage. Using such devices is convenient when washing certain frontal regions of the body such as the front of the legs, belly, chest, and neck, or other parts such as the face and arms, but becomes more challenging when individuals have to wash areas of the body that are harder to reach by hand, such as a person's upper and lower back area, behind the legs, or lower extremities. Washing difficult areas in the shower or bath can also prove difficult for people with limited dexterity such as the elderly, or those people that suffer from a physical disability that restricts their range of motion or limited muscle capacity. Also, the need to effectively stretch to reach and wash areas of the body that are hard to get at can often expose individuals to strains, muscle cramps, or other possible injuries as a result of slipping and falling in the shower.

Various devices have been developed and employed to better accommodate hygiene and assist individuals in accessing and washing hard to reach areas of the body when showering or bathing. One example comprises a conventional back scrub brush that generally includes an elongate handle, and a brush head attached to the distal end of the elongate handle where the brush head includes a plurality of bristles. Further designs provide telescoping handles to allow compact storage and portability of the device, or have replaced the bristle head with a sponge or exfoliating pads to replace bristles and provide comfortable use. In most cases, the elongate or extended handle comprises a rigid body constructed from wood or plastic, and sometimes includes a curved geometry to direct the brush head of the back scrubber towards the user's body. Also, back scrubbers typically include a washing head that is permanently affixed to, or integrally formed with, the end of the handle thereby forcing individuals to discard the apparatus as a whole when the washing head is worn and expired or damaged. Still other devices include for example, exfoliating back straps where a pair of handles are disposed at opposite ends of the strap where users grasp the handles with both hands, and shift the strap back and forth across the person's back.

Conventional back washers or scrubbers have provided limited assistance to individuals when washing various body parts, including hard to reach areas, in the bathtub or shower. Handheld sponges or wash clothes tend to slip and fall from the user's hand during use forcing the user to search for the cloth in the bath, or bend over to pick up the towel while in the shower exposing the user to falls. Further, most handheld bath or shower brushes include an elongate handle that is rigid and non-flexible, and include brush heads having rigid bristles or exfoliating heads that irritate a person's skin during use. Applying excessive pressure on the rigid handle simply translates to forcing the bristles of the brush head harder against the user's body and skin further irritating the skin. In addition, exfoliating straps require the use of both hands to hold onto the handles to slide the strap back and forth along the back area thus providing limited assistance to individuals with limited dexterity. Permanent disposition of the washing head at the end of a handle prevents users from interchanging washing or scrubbing heads, and negates the possibility of using back scrubbers with existing wash products like loofahs. The handheld loofahs include a loofah rope that can be secured to the person to prevent the loofah from falling during use, but the loofah is often difficult to use when having to wash hard to reach places such as the person's back, behind the legs, or when bending to wash the feet or between the toes. No prior art device exists that is adapted for use with a variety of different loofahs, and that allows users to wash hard to get areas of the body with a softer gentler washing tool such as a loofah.

Accordingly, there is a need for a body scrubbing appliance that resolves one or more of the shortcomings of the aforementioned known body washing and scrubbing devices.

SUMMARY OF THE INVENTION

A first embodiment of the invention provides a body scrubbing appliance removably holding a loofah for washing and scrubbing body parts of an individual, wherein the body scrubbing appliance comprises: a handle including at least two protrusions disposed on an outer surface of the handle to removably attach a loofah rope, a channel formed within a distal end of the handle and extending from a bottom and terminating at a top opening, and an inner ridge formed around an inner perimeter of the top opening, a biasing member removably inserted within the channel, a loofah support including a loofah holder adapted to releasably hold a loofah and integrally formed with a stem including a pair of flared ends, where the stem is inserted through the top opening and into the channel to axially compress the biasing member when excessive pressure is applied to the loofah holder, wherein the pair of flared ends engage the inner ridge to prevent the loofah support from separating with the handle, and wherein the loofah holder includes a gap to pass the handle rope of a loofah there through such that the loofah rope may be removably affixed to any of the at least two protrusions.

In one aspect, the handle comprises an oval geometric body to prevent the handle from rotating when held in a user's hand during use.

In another aspect, the at least two protrusions include three protrusions sequentially aligned along a vertical axis on the outer surface of the handle.

In still another aspect, the biasing member comprises a compression spring having a predetermined load and spring rate or value.

In another aspect, the loofah holder comprises any size, shape or configuration including a body shaped like a human hand including a palm and a plurality of digits extending from the palm where the palm and digits include a curved configuration to provide a concave formation adapted to hold a loofah therein.

In yet another aspect, the loofah holder includes at least one gap receiving the passage of a loofah rope there through where the loofah rope is removably attached to any of the protrusions.

In another aspect, the distal end of the handle comprises a round flange body that corresponds to the round geometrical shape of the stem.

In yet another aspect, the loofah support may be interchangeable with other loofah supports by simple removal of the stem from the channel of the handle where the flared ends are flexed together to pass through the top opening.

These and other objects, features, and advantages of the present invention will become more readily apparent from the attached drawings and the detailed description of the preferred embodiments, which follow.

BRIEF DESCRIPTION OF THE DRAWINGS

The preferred embodiments of the invention will hereinafter be described in conjunction with the appended drawings provided to illustrate and not to limit the invention, where like designations denote like elements, and in which.

Like reference numerals refer to like parts throughout the several views of the drawings.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper", "lower", "left", "rear", "right", "front", "vertical", "horizontal", and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Shown throughout the figures, the present invention is directed to a body scrubbing appliance for holding a variety of different loofahs having loofah ropes of varying lengths, and includes a handle, and a loofah support including a loofah holder and stem that moves axially within the handle, via a biasing member, to provide comfort and ease when washing and scrubbing various parts of a person's body such as the back areas, behind the legs and neck, and areas of the lower extremities. The handle includes a series of protrusions provided on the outer surface of the handle for removable attachment of loofah ropes to detachably secure a loofah in the loofah holder of the body scrubbing appliance.

Figure 1:
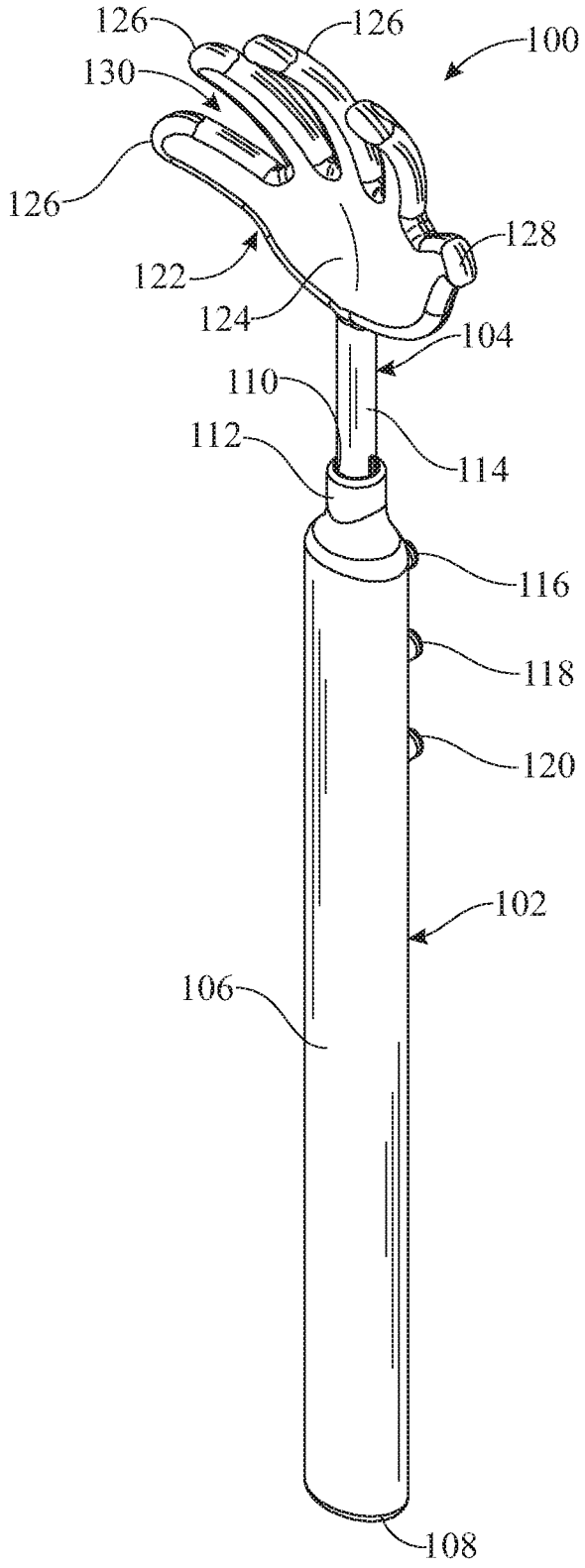
FIG. 1 is a front, perspective view of a body scrubbing appliance, showing a handle having a series of protrusions provided on the outer surface of the handle, and a loofah support including a loofah holder for supporting a variety of different loofahs, and a stem axially disposed and moveable within a channel formed in the handle, in accordance with an embodiment of the present invention.

Referring now to the drawings wherein like elements are represented by like numerals throughout, there is shown in FIG. 1 a front perspective view of a body scrubbing appliance 100, showing a handle 102, and a loofah support 104 axially disposed within the handle 102 for removable attachment of a loofah, in accordance with an embodiment of the present invention. The holding stance of the appliance 100 includes an elongate handle 102 having an oval shaped body 106 with a closed bottom 108, and an open top end 110 for receiving at least a portion of a loofah support 104 therein. The handle 102 includes a top flange 112 terminating in a general circular geometry and configured to accommodate the geometrical shape of a stem 114 provided on the loofah support 104. The oval configuration of the handle 102 aids to prevent rotation of the body scrubbing appliance 100 when grasping the handle 102 during use. It will be understood that the handle 102 may comprise any of a variety of lengths, sizes, and geometrical shapes. In one embodiment, the handle 102 is constructed from a plastic, wood, or light metal material, and may comprise any color, and/or include any design, pattern, symbol, logo, or other indicia. In one embodiment, the handle 102 may include friction enhancements to prevent slippage when held in the user's hand such as, but not limited to, ridges, protrusions, nubs, a rubber coating, grooves, or dimples.

Figure 3:
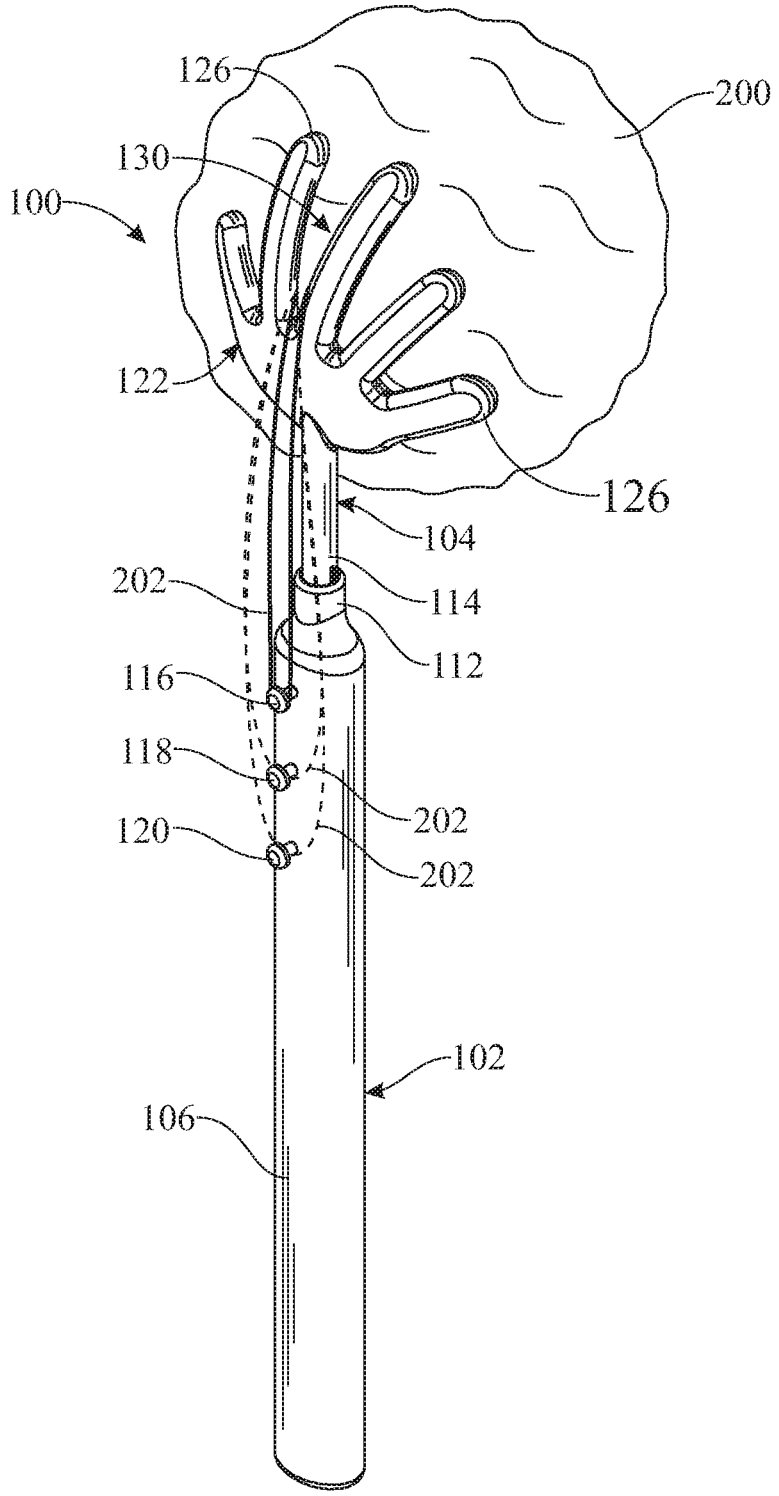
FIG. 3 is a back perspective view of the body scrubbing appliance of FIG. 1, showing a loofah securely disposed within the loofah holder of the loofah support and a loofah rope represented in different lengths attached one of a series of protrusions provided on the outer surface of the handle and adapted to securely retain the loofah within the loofah holder, in accordance with an embodiment of the present invention.

The handle 102 includes a series of protrusions 116, 118, and 120 each provided on the outer surface of the body 106, and near the top end of the handle 102, to removably attach loofah ropes 202 of varying lengths, as best illustrated in FIG. 3. It is well known that loofahs typically include a looped rope 202 attached to the mesh bundle of the loofah 200 that is adapted for securing the loofah 200 to the person by inserting a hand through the looped rope 202, and for hanging the loofah 200 on a designated hook, on a holder near a bathtub, or on a rack often provided in showers, for properly drying and storing the loofah. There are a variety of different loofahs 200 available on the market today that include ropes 202 of varying lengths. To accommodate such ropes of varying lengths, a series of protrusions 116, 118, 120 are provided on the body 106 of the handle 102 to secure a loofah 200 within a loofah holder 122 of the loofah support 104. In one non-limiting embodiment, each protrusion 116, 118, and 120 comprises a mushroom button that are each arranged, in sequence, along a vertical axis on the body 106 of the handle 102, and situated about a top portion of the handle 102. The mushroom button includes a short stem, and an expanded head attached to the stem where the expanded head provides a ridge to prevent a rope 202 from slipping off the button during use. It will be understood that other formations can be used to construct such protrusions 116, 118, 120 including for example, hooks, pegs, extending nubs, inverted U-shaped members, clips, integral semi-curved formation, or other suitable rope retaining mechanisms. In one alternative embodiment, such protrusions 116, 118, 120 may be permanently or removably attached to the handle 102. For example, the protrusions 116, 118, and 120 may be integrally formed with the handle 102 during a fabrication process such as casting, or injection molding. Alternatively, each protrusion 116, 118, 120 may be permanently attached to the outer surface 106 of the handle 102 using adhesive, or plastic welding techniques, or can be removably attached to the handle 102 using mechanical fasteners. For example, a series of apertures may be formed along a vertical axis within the body 106 of the handle 102 to removably receive and position protrusions 116, 118, 120 along various positions along the length of the handle 102 for readily accommodating loofah ropes 202 of any of a variety of lengths. For example, the series of apertures may include spring detents, threads, magnets, or a bayonet connection, to allow removable insertion of the protrusions 116, 118, 120. The size, shape and dimensional characteristics of each protrusion 116, 118, 120 is selected to efficiently and effectively removably hold loofah ropes 202 of varying lengths and sizes to securely retain a variety of different loofahs 200 within the loofah holder 122 of the loofah support 104. Each protrusion 116, 118 and 120 may also include a notch, cutout, or a non-slip material adapted to prevent the rope 202 from slipping off, or detaching from the protrusions 116, 118, and 120 during use.

Figure 2:
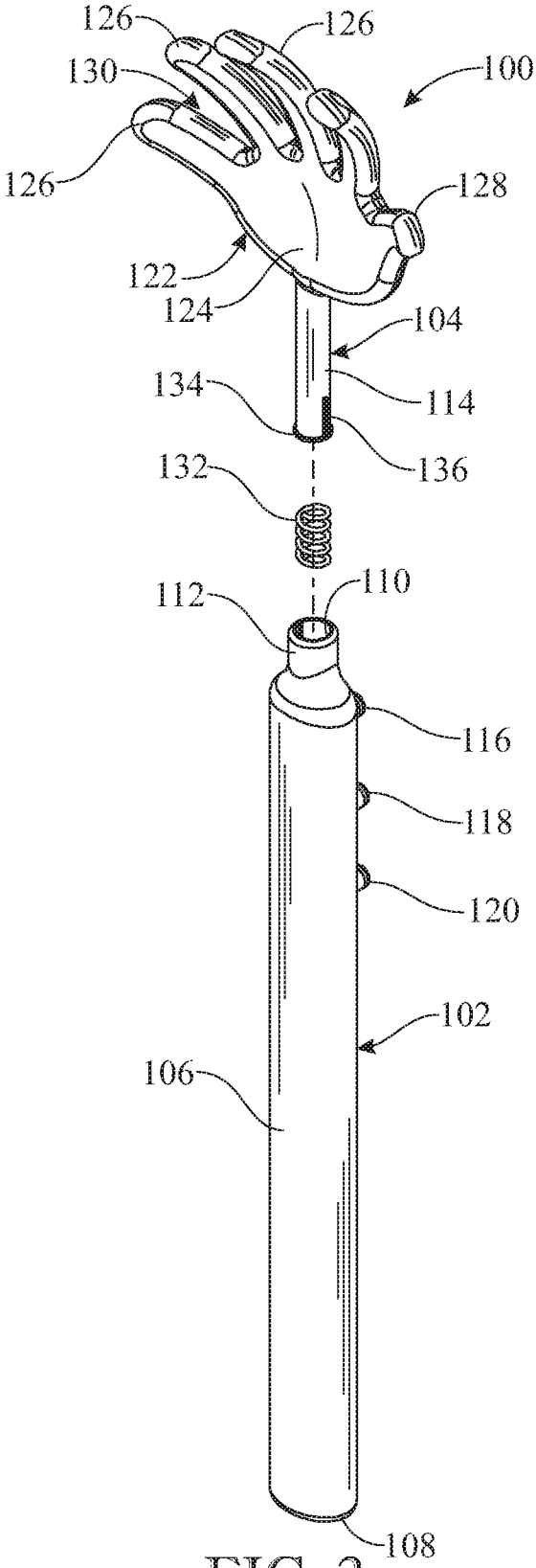
FIG. 2 is an exploded view of the body scrubbing appliance of FIG. 1, showing the handle, the loofah support detached from the handle, and a biasing member to permit axial movement of the loofah support when disposed within the channel of the handle upon application of a predetermined amount of pressure to the loofah support, in accordance with an embodiment of the present invention.

With continued reference to FIGS. 1 and 2, the loofah support 104 includes a loofah holder 122 that is formed integral with, or attached separately to, a support stem 114. In one non-limiting embodiment, a support stem 114 comprises a predetermined length, and includes a generally round or circular body corresponding with the round geometric formation of the flange opening 110 formed at the distal end of the handle 102. In one non-limiting embodiment, the loofah holder 122 comprises an aesthetic appearance of a human hand having a palm area 124, and extending digits 126, 128 to replicate the fingers and thumb of the human hand, respectively. As illustrated in FIG. 1, both the palm area 124 and extending digits 126, 128 comprise a curved configuration or a curved formation that is adapted to hold a loofah 200 therein, as better illustrated in FIG. 3. The digits 126, 128 are spaced apart from each other a predetermined width to provide one or more gaps 130 adapted to accommodate passage of a loofah rope 202 when a loofah 200 is retained within the loofah holder 122. It will be understood that the loofah holder 122 may include any number of geometrical shapes or configurations, and may comprise for example, the shape of a motif, a character, or other formation. For example, loofah holder 122 may comprise the shape of an animal, such as a fish, or a cartoon character that is appealing to children. As such, it is possible to have interchangeable loofah supports 114 to accommodate various aesthetic appeals. In yet another embodiment, the loofah holder 122 may be shaped to represent a team mascot, or a particular logo. An objective feature is to provide a loofah holder 122 that includes a gap 130 or an opening to permit passage of a loofah rope 202 there through when removably attaching a loofah 200 to the loofah holder 122. The palm area 124 of the loofah holder 122 may include a smooth, outer surface, or alternatively include a non-slipping surface having a friction coating material.

Figure 4:
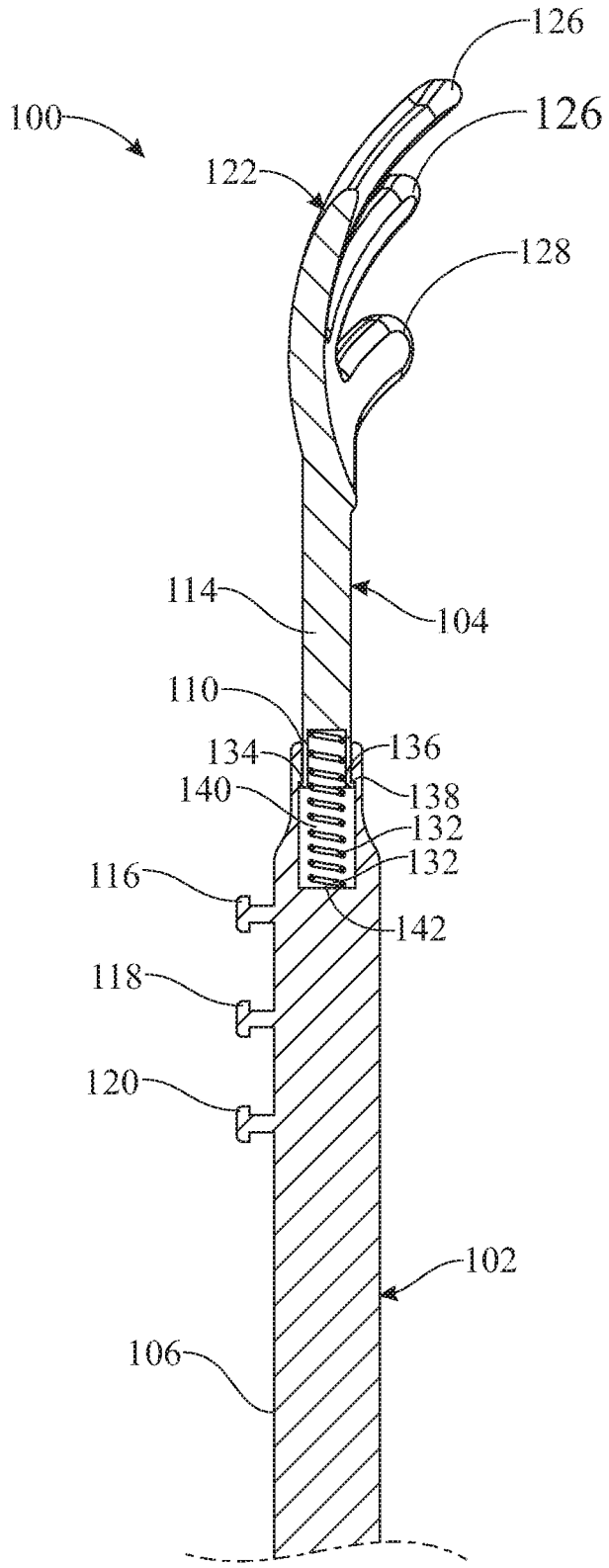
FIGS. 4 and 5 are partial, cross-section views of the body scrubbing appliance of FIG. 1, showing the stem of the loofah support axially displaced within the handle, via a biasing member, with the loofah support shown both extracted when the biasing member is in a non-compressed state, and retracted when the biasing member is in a compressed state, respectively, in accordance with an embodiment of the present invention.
Figure 5:
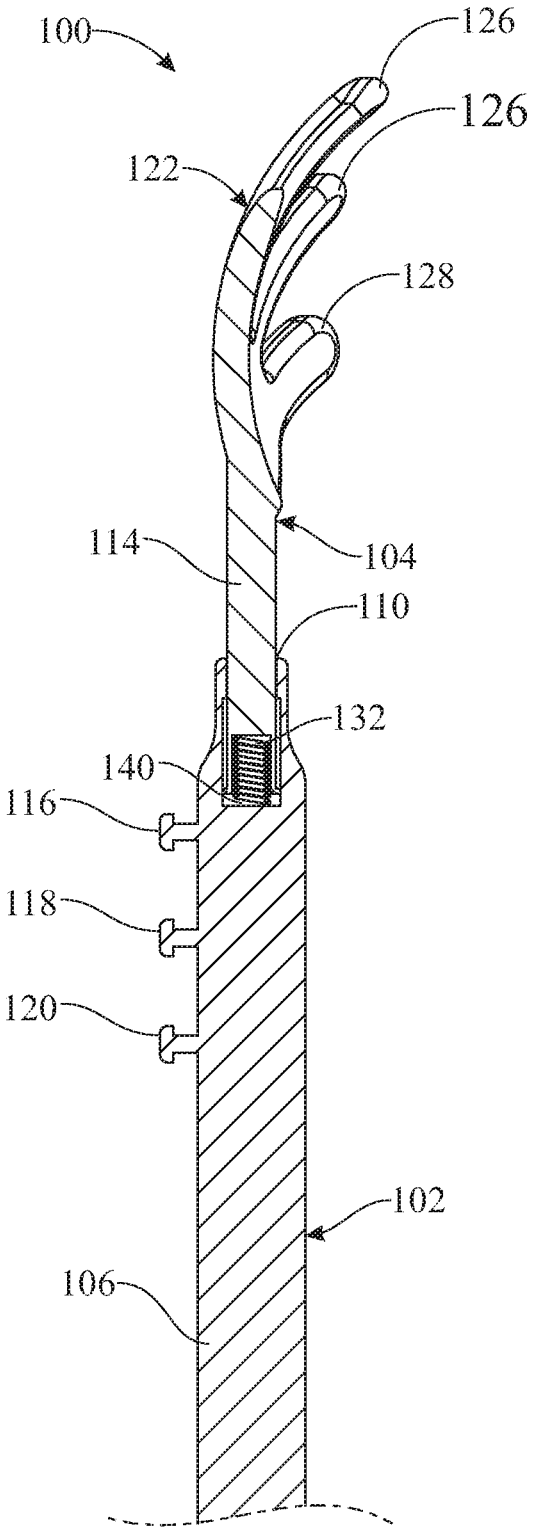

Turning now to FIGS. 2, 4, and 5, there are illustrated an exploded view, and partial cross-section views of the body scrubbing appliance 100, respectively, showing the loofah support 104 readily disposed within the top opening 110 of the handle 102 and axially moveable, via a biasing member 132, between a fully extended state and a fully retracted state when the biasing member 132 is fully expanded and fully compressed, respectively, in accordance with an embodiment of the present invention. The proximate end of the stem 114 includes a pair of flared ends 134, 136 each provided on opposite sides of the stem 114 and extending slightly outwards to readily engage with, or butt against, an inner circular ridge 138 provided on an inner top surface of a channel 140 formed within a top portion of the handle 102. The flared ends 134, 136 may flex slightly together under pressure to allow insertion of the proximate end of the stem 114 within the top opening 110, and into the channel 140 of the handle 102. As shown in FIG. 4, the channel 140 extends from a bottom surface 142 and terminates at the top opening 110 a certain length to receive at least a portion of the stem 114 therein. The shape and diameter of the channel 140 is selected to correspond with the shape and diameter of the support stem 114.

A biasing member 132 is inserted through the top 110 and disposed within the channel 140 of the handle 102 to rest on the bottom surface 142. One end of the biasing member 132 operatively engages a portion of the proximal end of the support stem 114 when the stem 114 is disposed into the channel 140. In one alternative embodiment, the stem 114 may include an aperture configured to receive at least a portion of one end of the biasing member 132 therein. In a preferred embodiment, the biasing member 132 comprises a compression spring structured to oppose compression and return to its uncompressed length or state when a threshold applied force is removed. The biasing member 132 may be constructed from any well-known metal or plastic material. A metal biasing member 132 can be coated with a water resistant or corrosion free material, or the biasing member 132 itself can be constructed from a galvanized metal or stainless steel material designed to resist rust. It is contemplated that the load and spring rate characteristics of the biasing member 132 are designed and selected to permit axial movement of the stem 114 within the channel 140 of the handle 102 when a predetermined amount of pressure is applied to the loofah holder 122 when using the body scrubbing appliance 100. As such, the amount of force applied to the loofah holder 122 of the body scrubbing appliance 100 to axially move the stem 114 within the channel 140 of the handle 102 is proportional or determined by the load and spring rates or values formulated when fabricating or selecting the biasing member 132. As illustrated in FIG. 4, the biasing member 132 is shown in a relaxed uncompressed state to bias or push the stem 114 upwards and outwards of the channel 140, until each flared end 134, 136 of the stem 114 engages the inner ridge 138 to prevent the stem 114 from sliding out of the channel 140 from the top opening 110, thus, the flared ends 134, 136 and the inner ridge 138 at least partially and cooperatively define a loofah support retention assembly. It will be understood that the biasing member 132 may comprise a plurality of biasing elements including several compression springs, resilient bands, leaf spring, deformable or resilient miniature devices such as balls, or a resilient mass of rubber. A seal (not shown) may be provided around the outer perimeter of the top opening 110 to prevent water or dirt from entering the channel 140.

As illustrated in FIG. 5, the body scrubbing appliance 100 provides a loofah support 104 including a stem 114 that moves along a longitudinal axis within a channel 140, via a biasing member 132 when at least a threshold amount of force is applied to the loofah holder 122. The axial movement of the loofah support 104 is designed to promote comfort, and to prevent aggravating or irritating the skin of a person as a result of applying up to a predetermined maximum force on the handle 102 when using the body scrubbing appliance 100, a detriment often experienced with known body scrubbing devices. For example, conventional body scrubbers typically include a rigid handle that includes a brush head with bristles. Users typically grasp the handle and apply a pushing force on the handle to press the bristles of the brush head against the body to scrub and wash the body. Applying a greater force on the handle of the scrubber often results in pushing the bristles harder against the body and skin of the user thus irritating or damaging the person's skin. However, applying little force on the handle of conventional scrubbers reduces the washing or scrubbing effect of the brush head as the bristles do not adequately push against the body or skin of the person. The body scrubbing appliance 100 solves this concern in that application of a predetermined maximum force on the loofah holder 122 forces the stem 114 of the loofah support 104 to move axially within the channel 140 of the handle 102, to fully compress the biasing member 132, thus allowing the loofah support 104 to move into a fully retracted position relative to the handle 102. Thus, the excessive or predetermined maximum applied force is absorbed by the biasing member 132 to effectively prevent damage or irritation to a person's skin when negotiating the handle 102 during use. As noted earlier, the load and spring rate of the biasing member 132 is selected to permit up to a predetermined maximum pressure to be applied to the loofah holder 122 without causing an attached loofah 200 to irritate the skin of users but yet provide an effective means for washing and scrubbing the body parts. An alternative embodiment may include a control adapted to adjust the compression characteristics of the biasing member 132. For example, a control mechanism may be associated with an element provided on the bottom surface 142 to move upwards within the channel 140 to change the length of the biasing member 132, and thus, the biasing force. The beneficial feature of the biasing member 132 provides a body scrubbing appliance 100 including a loofah support 104 having a stem 114 that moves axially within the channel 140 within the handle 102 where the biasing member 132 changes from a relaxed uncompressed state to fully extract the loofah support 122, as shown in FIG. 4, to a compressed state to retract the loofah support 122, as shown in FIG. 5. Changes in compression state of the biasing member 132 helps absorb excessive forces applied to the loofah support 122 when maneuvering the handle 102 of the appliance 100 to wash or scrub parts of a person's body.

With reference made to FIG. 3, there is shown a back perspective view of the body scrubbing appliance 100 for use with a variety of loofahs 200 having a loofah rope 202 of different or varying lengths, in accordance with an embodiment of the present invention. In preparation of using the body scrubbing appliance 100 to wash and scrub hard to reach places on a person's body, a user simply places a loofah 200 within the loofah holder 122 allowing the loofah 200 to rest against the palm 124, and the extending digits 126 and 128. The loofah rope 202, that is commonly provided with loofahs 200, is guided through a gap 130 where the end of the loofah rope 202 is attached to a first protrusion 116 allowing the loofah rope 202 to pull on, and retain, the loofah 200 securely within the loofah holder 122. The same steps are undertaken when attaching a variety of different loofahs 200 to the loofah holder 122 of the body scrubbing appliance 100. The body scrubbing appliance 100 is compatible for use with loofahs 200 having loofah ropes 202 of varying lengths. For example, a loofah 200 having a longer loofah rope 202 is placed within the loofah holder 122 to rest against the extending digits 126 and 128, and the longer loofah rope 202 is guided through the gap 130 and attached to either the second or third protrusion 118, 120, respectively, such that the loofah rope 202 pulls on the loofah 200 to securely retain the loofah 200 within the loofah holder 122 ready for use. As such, users can freely interchange, replace, or use a variety of different loofahs 200 having loofah ropes 202 of varying lengths.

Figure 6:
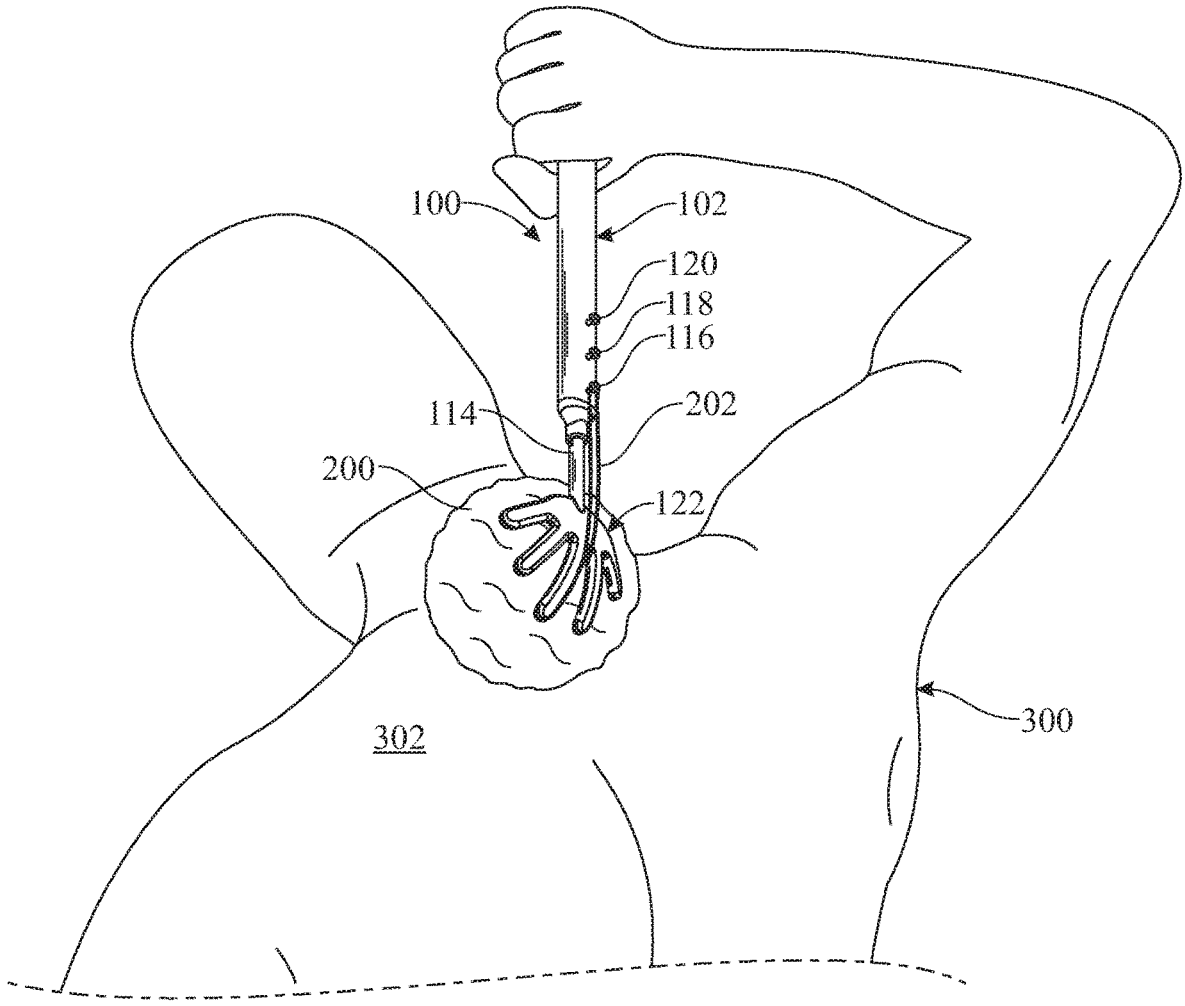
FIG. 6 is an operative view of a person holding the body scrubbing appliance of the present invention and washing and scrubbing the back of the neck and upper back area of the body with a loofah secured within the loofah support of the scrubbing appliance with the loofah rope attached to one of the designated protrusions provided on the outer surface of the handle, in accordance with another embodiment of the present invention.

Turning now to FIG. 6 there is shown an operative view of a person 300 holding the body scrubbing appliance 100 in hand and washing and scrubbing the back of the neck and upper back area 302 with a loofah 200 secured within the loofah holder 122 of the loofah support 104, in accordance with an embodiment of the present invention. In preparation of a person taking a bath or a shower, the person 300 attaches a loofah 200 to the loofah holder 122 of the loofah support 104, and passes the loofah rope 202 through a designated gap 130, and attaches the end of the loofah rope 202 to one of the protrusions 116, 118, 120 to secure the loofah 200 in place. The person 300 grasps the handle 102 by hand and compresses the loofah 200 against the person's body to wash and scrub the body parts, such as the upper back region 302. Excessive pressure that is applied to the loofah holder 122 during use, will force the stem 114 of the loofah support 104 to move axially within the channel 140 to compress the biasing member 132, as demonstrated in FIG. 5. Once the applied pressure is reduced or removed, the biasing member 132 will force the stem 114 outward from the channel 140 allowing each flared end 134, 136 to engage under the inner circular ridge 138 of the channel 140 to prevent further outward movement of the loofah support 104 from the channel 140.

The body scrubbing appliance 100 provides an effective hygiene appliance adapted for detachably holding a variety of different loofahs 200 having ropes 202 of varying lengths, and includes a loofah support 104 having a stem 114 that moves axially within a handle 102 against a biasing member 132 when a predetermined amount of force or pressure is applied to the support 104 during use, to provide comfort when washing and scrubbing various parts of a person's body. The body scrubbing appliance 100 may include a variety of additional features such as an adjustable length handle or a telescoping handle, that allows users to reach extended body parts or extremities, and to provide compact storage and portability of the body scrubbing appliance 100. The body scrubbing appliance 100 may also include a hook, strap, magnet, suction cup, or a ring attached to the handle 102 to store or hang the body scrubbing appliance 100 when not in use.

Alternative embodiments are contemplated in addition the embodiments(s) shown and/or described herein. For example, with reference to FIGS. 7 through 10, one alternative embodiment of a body scrubbing appliance 500 is presented.

Figure 7:
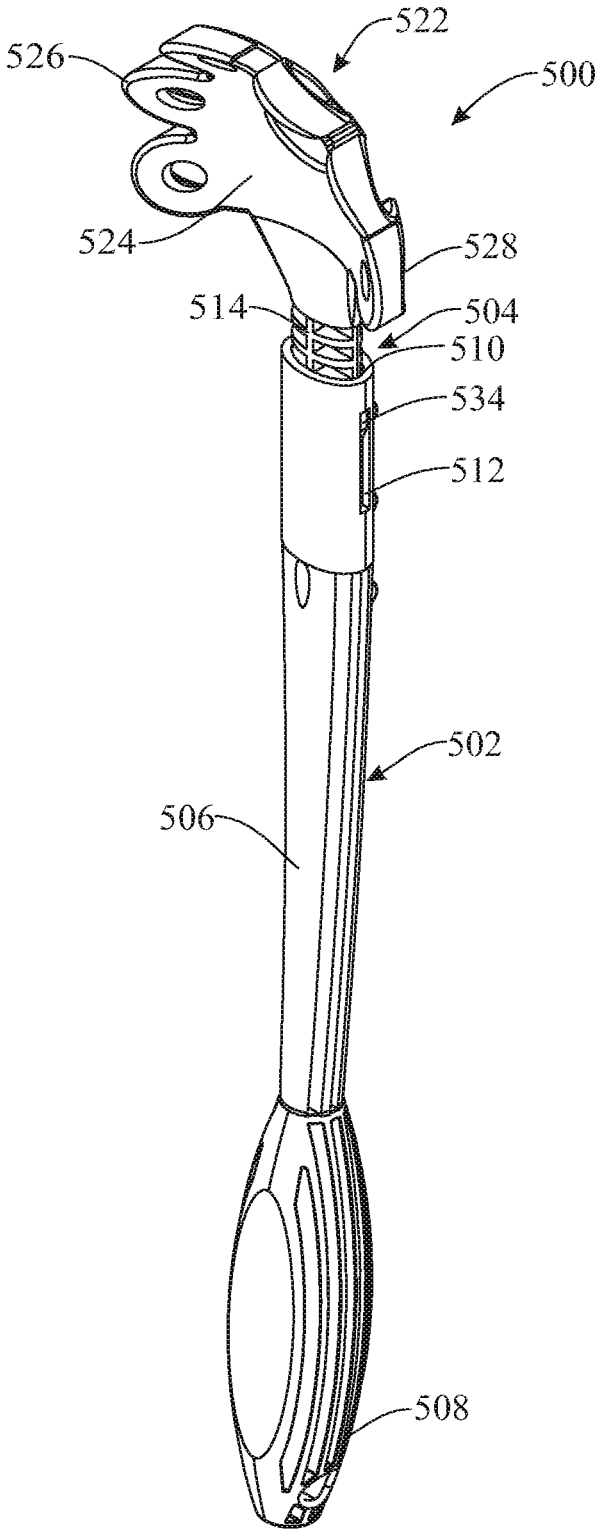
FIG. 7 is a front, perspective view of one alternate embodiment of a body scrubbing appliance, showing a handle and a loofah support including a loofah holder for operatively engaging a variety of different loofahs, and a support stem axially disposed and moveable within a channel formed in the handle, in accordance with a further embodiment of the present invention.

With reference to FIG. 7, there is shown a front perspective view of one alternative embodiment of a body scrubbing appliance 500 having a handle 502, and a loofah support 504 axially disposed within at least a portion of the handle 502 for removable attachment of a loofah 200, in accordance with the present invention. The body scrubbing appliance 500 includes an elongate handle 502 having an oval shaped body 506 with a grip 508 on an end opposite the loofah support 504, and an open top end 510 for receiving at least a portion of the loofah support 504 therein. The handle 502 includes a travel track 512 on either side, each dimensioned and configured to movably receive therein a corresponding one of the travel tabs 534, 536 affixed to opposite sides of a support stem 514 of the loofah support 504. The oval configuration of the handle 502 aids to prevent rotation of the body scrubbing appliance 500 when grasping the handle 502 during use. It will be understood that the handle 502 may comprise any of a variety of lengths, sizes, and geometrical shapes. In one embodiment, the handle 502 is constructed from a plastic, wood, or light metal material, and may comprise any color, and/or include any design, pattern, symbol, logo, or other indicia. In the alternate embodiment of FIG. 7, the handle 502 includes a grip 508 which includes friction enhancements to prevent slippage when held in the user's hand. It is to be understood that the friction enhancements may include, but are in no manner limited to, ridges, protrusions, nubs, a rubber coating, grooves, or dimples.

Figure 10:
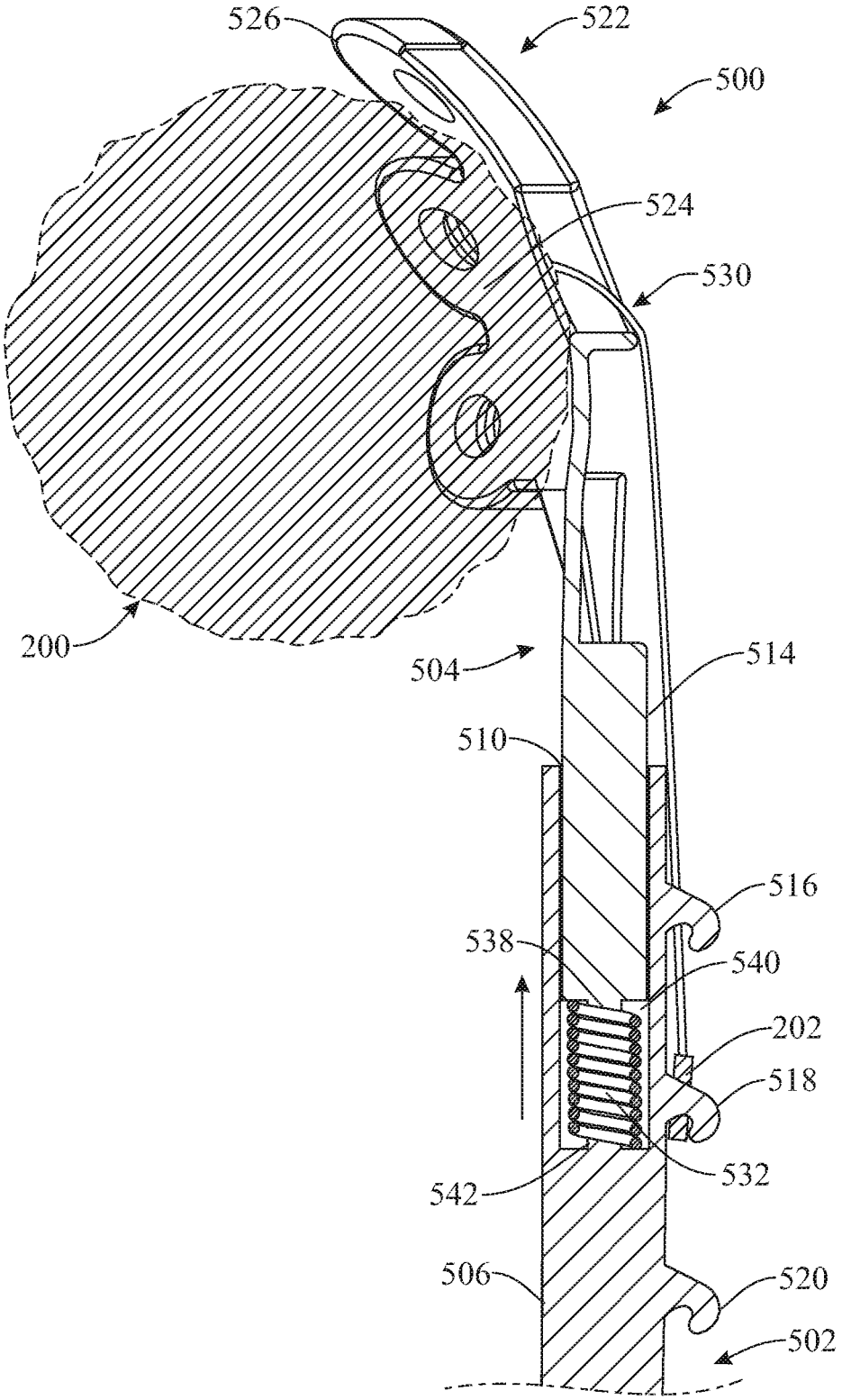
FIG. 10 is a partial, cross-sectional view of the alternate embodiment of the body scrubbing appliance of FIG. 7, showing the support stem of the loofah support axially disposed within the handle, via a biasing member, with the loofah support shown when the biasing member is in a compressed state, in accordance with a further embodiment of the present invention.

The handle 502 includes a series of protrusions 516, 518 and 520 each provided on the outer surface of the body 506, and near the top end of the handle 502, to removably attach loofah ropes 202 of varying lengths, as best illustrated in FIG. 10. As before, it is well known that loofahs typically include a looped rope 202 attached to the mesh bundle of the loofah 200 that is adapted for securing the loofah 200 to the person by inserting a hand through the looped rope 202, and for hanging the loofah 200 on a designated hook for proper drying and storage of the loofah 200. Also as before, to accommodate such ropes of varying lengths, a series of protrusions 516, 518 and 520 are provided on the body 506 of the handle 502 to secure a loofah 200 within a loofah holder 522 of the loofah support 504, once again, as shown best in the illustrative embodiment of FIG. 10. In one non-limiting embodiment, each protrusion 516, 518 and 520 includes a hook or peg having an integral semi-curved formation, as is shown in the figures.

As before, in one alternative embodiment, the protrusions 516, 518 and 520 may either be permanently or removably attached to the handle 502. For example, the protrusions 516, 518 and 520 may be integrally formed with the handle 502 during a fabrication process such as casting, or injection molding. Alternatively, each protrusion 516, 518 and 520 may be permanently attached to the outer surface 506 of the handle 502 using adhesive, or plastic welding techniques, or they can be removably attached to the handle 502 using mechanical fasteners. For example, a series of apertures may be formed along a vertical axis within the body 506 of the handle 502 to removably receive and position protrusions 516, 518 and 520 along various positions along the length of the handle 502, to allow for accommodating loofah ropes 202 of any of a variety of lengths. As before, the series of apertures may include spring detents, threads, magnets, or a bayonet connection, to allow removable insertion of the protrusions 516, 518 and 520 therein. The size, shape and dimensional characteristics of each protrusion 516, 518 and 520 is selected to efficiently and effectively yet removably hold loofah ropes 202 of varying lengths and sizes to securely retain a variety of different loofahs 200 within the loofah holder 522 of the loofah support 504. Each protrusion 516, 518 and 520 may also include a notch, cutout, or a non-slip material adapted to prevent the rope 202 from slipping off, or detaching from the protrusion 516, 518 and/or 520 during use.

Figure 9:
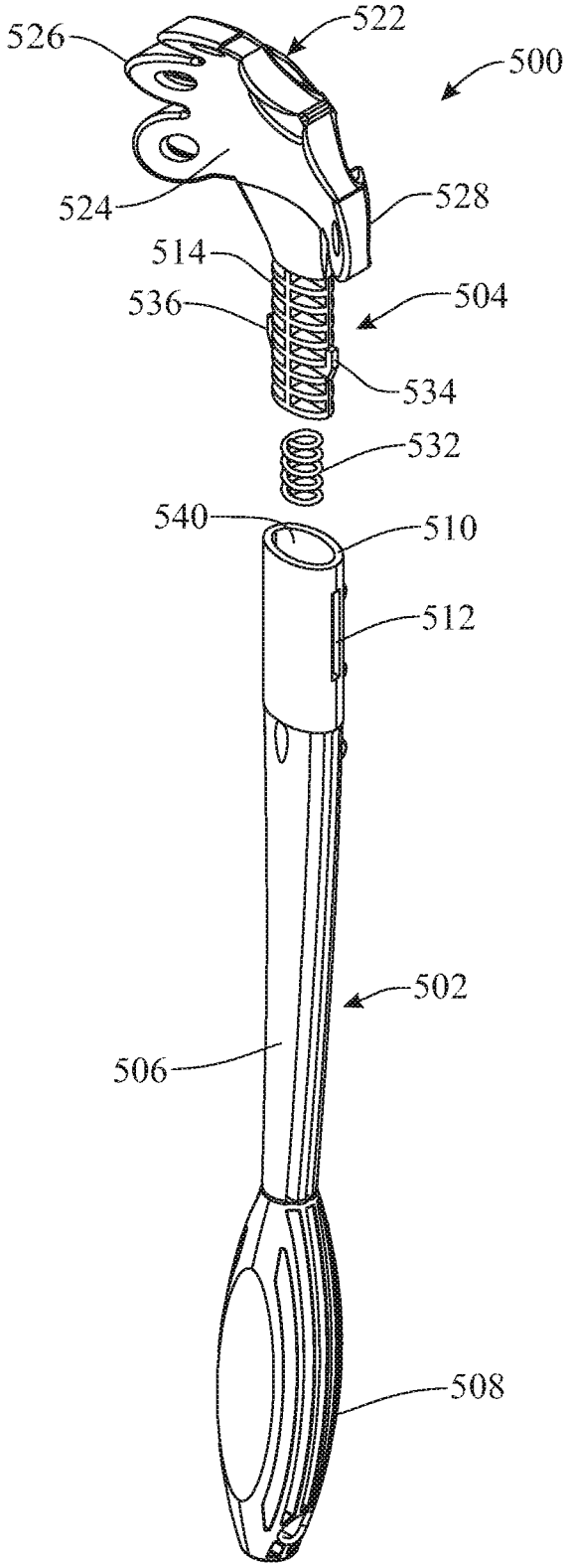
FIG. 9 is an exploded view of the alternate embodiment of the body scrubbing appliance of FIG. 7, showing the handle, the loofah support detached from the handle, and a biasing member to permit axial movement of the loofah support when disposed within the channel of the handle upon application of a predetermined amount of pressure to the loofah support, in accordance with a further embodiment of the present invention.

With continued reference to FIGS. 7 and 9, the loofah support 504 includes a loofah holder 522 that is formed integral with or otherwise attached to a support stem 514. In one non-limiting embodiment, a support stem 514 comprises a predetermined length, and includes a generally oval body corresponding to the oval geometric configuration of a top opening 510 formed in a distal end of the handle 502. In one non-limiting embodiment, the loofah holder 522 comprises a human hand like shape having a palm area 524, and extending digits 526, 528 extending outwardly therefrom. As illustrated best in FIG. 7, both the palm area 524 and extending digits 526, 528 comprise a curved configuration or a curved formation that is adapted to hold a loofah 200 therein, once again, as best illustrated in FIG. 10. The digits 526, 528 are spaced apart from each other a predetermined width to provide at least one gap 530 there between configured to accommodate passage of a loofah rope 202 there through when a loofah 200 is retained within the palm area 524 of the loofah holder 522. As before, it will be understood that the loofah holder 522 may include any number of geometrical shapes or configurations, and may comprise for example, the shape of a motif, a character, or other formation. By way of example, once again, a loofah holder 522 may comprise the shape of an animal, such as a fish, or a cartoon character that is appealing to children. As such, it is possible to have interchangeable loofah supports 504 to accommodate various aesthetic appeals. In yet another embodiment, the loofah holder 522 may be shaped to represent a team mascot, or a particular logo. An objective feature is to provide a loofah holder 522 that includes a gap 530 or an opening to permit passage of a loofah rope 202 there through when removably attaching a loofah 200 to the loofah holder 522. The palm area 524 of the loofah holder 522 may include a smooth, outer surface, or alternatively include a non-slipping surface having a friction coating material.

Turning next to the FIGS. 9 and 10, there are presented an exploded view and a partial cross-sectional view of the alternate embodiment of a body scrubbing appliance 500, respectively, showing a portion of the loofah support 504 movably disposable within the top opening 510 of the handle 502 and axially moveable, via a biasing member 532, between a fully extended state, when the biasing member 532 is fully expanded, and a fully retracted state, when the biasing member 532 is fully compressed, such as is shown in FIG. 10. The support stem 514 includes a pair of travel tabs 534, 536 each affixed on opposite sides of and extending outwardly from the support stem 514, as shown best in FIG. 9. The travel tabs 534, 536 are dimensioned and configured to be movable within a different one of each of the travel tracks 512 disposed along opposite sides of the handle 502, thereby allowing at least a portion of the support stem 514 to be moveable within the channel 540 of the handle 502 without becoming detached therefrom. Stated otherwise, the travel tabs 534, 536 are dimensioned and configured such that they are only moveable between an upper limit disposed at the top end of a corresponding travel track 512, such as is shown in the illustrative embodiments of FIGS. 7 and 8, wherein the support stem 514 is fully extended outwardly from the handle 502, and a lower limit at the bottom of the corresponding travel track (not shown) wherein the support stem 514 is fully retracted into the handle 502, such as is shown in FIG. 10. As will be appreciated, the travel tabs 534, 536 and the corresponding travel tracks 512 at least partially and cooperatively define a loofah support retention assembly. As shown in FIG. 10, the channel 540 extends from the top opening 510 a certain length to receive at least a portion of the support stem 514 therein. The shape and diameter of the channel 540 is selected to correspond with the shape and diameter of the support stem 514. It is to be appreciated that the support stem 514 and the channel 540 may comprise any of a variety of geometrical configurations and dimensions.

A biasing member 532 is inserted through the open top 510 and is disposed within the channel 540 of the handle 502 into an operative engagement with a lower biasing member support 542 disposed on the bottom surface of channel 540, as shown in the illustrative embodiment of FIG. 10. In one embodiment, a lower biasing member support 542 is dimensioned and configured to receive at least a portion of a biasing member 532 thereon, such as is shown in FIG. 10, while in at least one further embodiment, a lower biasing member support 542 is dimensioned and configured to receive at least a portion of a biasing member 532 therein. An opposite end of the biasing member 532 operatively engages a lower portion of the support stem 514 when the support stem 514 is disposed into the channel 540. In at least one alternative embodiment, and again as shown in FIG. 10, the lower portion of the support stem 514 includes an upper biasing member support 538 which is dimensioned and configured to receive at least a portion of one end of the biasing member 532 thereon. In at least one further embodiment, an upper biasing member support 538 which is dimensioned and configured to receive at least a portion of one end of the biasing member 532 therein. In at least one embodiment, the biasing member 532 comprises a compression spring structured to oppose compression and return to its uncompressed length or state when an applied force is removed. As before, the biasing member 532 may be constructed from any well-known metal or plastic material. A metal biasing member 532 can be coated with a water resistant or corrosion free material, or the biasing member 532 itself can be constructed from a galvanized metal or stainless steel material designed to resist rust.

It is contemplated that the load and spring rate characteristics of the biasing member 532 arm designed and selected to permit axial movement of the support stem 514 within the channel 540 of the handle 502 when a predetermined amount of pressure is applied to the loofah holder 522 when using the body scrubbing appliance 500. As such, and as before, the amount of force applied to the loofah holder 522 of the body scrubbing appliance 500 to axially move the support stem 514 within the channel 540 of the handle 502 is proportional or determined by the load and spring rates or values formulated when fabricating or selecting the biasing member 532. It is to be understood that the biasing member 532 may comprise a plurality of biasing elements including several compression springs, resilient bands, leaf spring, deformable or resilient miniature devices such as balls, or a resilient mass of rubber. A seal (not shown) may be provided around the outer perimeter of the top opening 510 to prevent water or dirt from entering the channel 540.

As illustrated in FIG. 10, the body scrubbing appliance 500 provides a loofah support 504 including a support stem 514 that moves along a longitudinal axis within a channel 540, as shown by the directional arrow in FIG. 10, via a biasing member 532 when at least a threshold amount of force is applied to the loofah holder 522. The axial movement of the loofah support 504 is designed to promote comfort, and to prevent aggravating or irritating the skin of a person as a result of applying up to a predetermined maximum force on the handle 502 when using the body scrubbing appliance 500, a detriment often experienced with known body scrubbing devices. For example, and as noted above, conventional body scrubbers typically include a rigid handle that includes a brush head with bristles. As before, users typically grasp the handle and apply a pushing force on the handle to press the bristles of the brush head against the body to scrub and wash the body. Applying a greater force on the handle of the scrubber often results in pushing the bristles harder against the body and skin of the user thus irritating or damaging the person's skin. However, applying little force on the handle of conventional scrubbers reduces the washing or scrubbing effect of the brush head as the bristles do not adequately push against the body or skin of the person. The alternate embodiment of the body scrubbing appliance 500 solves this concern in that application of a predetermined maximum force on the loofah holder 522 forces the stem 514 of the loofah support 504 to move axially within the channel 540 of the handle 502, to fully compress the biasing member 532, thus allowing the loofah support 504 to move into a fully retracted position relative to the handle 502. Thus, the excessive or predetermined maximum applied force is absorbed by the biasing member 532 to effectively prevent damage or irritation to a person's skin when negotiating the handle 502 during use. As noted earlier, the load and spring rate of the biasing member 532 is selected to achieve predetermined maximum pressure applied to the loofah holder 522 without causing an attached loofah 200 to irritate the skin of users but yet provide an effective means for washing and scrubbing the body parts.

Figure 8:
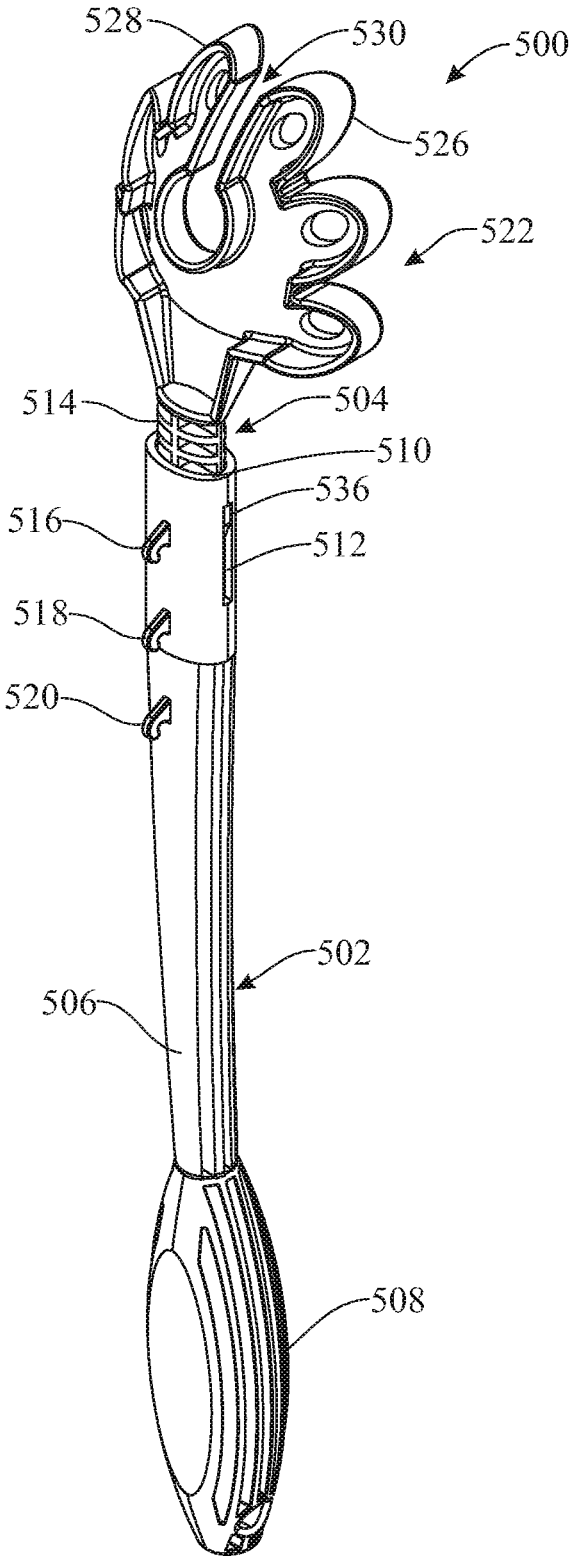
FIG. 8 is a back perspective view of the alternate embodiment of the body scrubbing appliance of FIG. 7, showing a series of protrusions provided on the outer surface of the handle and adapted to securely retain a loofah within the loofah holder, in accordance with a further embodiment of the present invention.

A further alternative embodiment may include a control mechanism adapted to adjust the compression characteristics of the biasing member 532. For example, a control mechanism may be associated with the lower biasing member support 542 to move upwards or downwards within the channel 540 to change the length of the biasing member 532 when in an extended state, thus, changing the biasing force. Once again, the beneficial feature of the biasing member 532 provides a body scrubbing appliance 500 including a loofah support 504 having a support stem 514 that moves axially within the channel 540 in the handle 502, wherein the biasing member 532 changes from a relaxed uncompressed state to fully extend the loofah support 522, as shown in FIGS. 7 and 8, to a compressed state to fully retract the loofah support 522, as shown in FIG. 10. Changes in the compression state of the biasing member 532 helps absorb excessive forces applied to the loofah support 522 when maneuvering the handle 502 of the body scrubbing appliance 500 to wash or scrub parts of a person's body.

As with the embodiment of FIGS. 1 through 6, the alternate embodiment of the body scrubbing appliance 500 as shown in FIGS. 7 through 10 provides an effective hygiene appliance adapted for detachably holding a variety of different loofahs 200 having ropes 202 of varying lengths, and includes a loofah support 504 having a support stem 514 that moves axially within a handle 502 against a biasing member 532 when a predetermined amount of force or pressure is applied to the support 504 during use, to provide comfort and to prevent damage to the skin when washing and scrubbing various parts of a person's body. The body scrubbing appliance 500 may include a variety of additional features such as an adjustable length handle or a telescoping handle, that allows users to reach extended body parts or extremities, and to provide compact storage and portability of the body scrubbing appliance 500. The body scrubbing appliance 500 may also include a hook, strap, magnet, suction cup, or a ring attached to the handle 502 to store or hang the body scrubbing appliance 500 when not in use.

Since many modifications, variations, and changes in detail can be made to the described preferred embodiments of the invention, it is intended that all matters in the foregoing description and shown in the accompanying drawings be interpreted as illustrative and not in a limiting sense. Furthermore, it is understood that any of the features presented in the embodiments may be integrated into any of the other embodiments unless explicitly stated otherwise. The scope of the invention should be determined by the appended claims and their legal equivalents.

What is claimed is:

1. A body scrubbing appliance for operative attachment of a loofah having a loofah rope attached thereto for use by a person to scrub hard to access body parts, wherein the loofah rope may be of any of a plurality of different lengths, said body scrubbing appliance comprising:

a handle including at least one protrusion disposed on an outer surface of said handle, said protrusion configured to releaseably attach at least a portion of the loofah rope thereto, a channel formed within one end of said handle and accessible through an open top end thereof, a loofah support including a loofah holder dimensioned and configured to securely yet releaseably maintain at least a portion of the loofah therein, said loofah support further comprising a support stem at least partially disposable through said open top end of said handle and into said channel, a biasing member disposed in said channel of said handle in an operative engagement with said support stem of said loofah support, said biasing member maintains said loofah support in a fully extended position relative to said handle when said biasing member is disposed in a substantially uncompressed state, and said biasing member allows said loofah support to move into a fully retracted position relative to said handle when said biasing member is disposed in a substantially compressed state.

2. The body scrubbing appliance of claim 1 wherein said handle comprises a plurality of protrusions disposed on an outer surface thereof.

3. The body scrubbing appliance of claim 2 wherein each of said plurality of protrusions is configured to releaseably attach at least a portion of the loofah rope having a different one of the plurality of lengths thereto.

4. The body scrubbing appliance of claim 2 wherein said plurality of protrusions are disposed in an aligned arrangement along the outer surface of the handle.

5. The body scrubbing appliance of claim 1 wherein said loofah holder comprises a hand like configuration including a palm area having a plurality of digits extending therefrom.

6. The body scrubbing appliance of claim 5 wherein said palm area of said loofah holder comprises a concave configuration.

7. The body scrubbing appliance of claim 5 wherein said loofah holder comprises at least one gap disposed between at least one adjacent pair of said digits, said gap dimensioned to receive at least a portion of the loofah rope there through, such that the loofah rope may be releasably attached to said at least one protrusion on said handle.

8. The body scrubbing appliance of claim 5 wherein said loofah holder comprises a plurality of gaps, each of said plurality of gaps disposed between different adjacent pairs of said digits, each of said plurality of gaps dimensioned to receive at least a portion of the loofah rope there through, such that the loofah rope may be releasably attached to said at least one protrusion on said handle.

9. The body scrubbing appliance of claim 1 further comprising a plurality of loofah supports, wherein each of said plurality of loofah supports is interchangeable within said handle.

10. The body scrubbing appliance of claim 1 wherein said handle comprises an oval shaped body to prevent said handle from rotating in the person's hand while in use.

11. The body scrubbing appliance of claim 1 wherein said biasing member comprises a compression spring having a predetermined spring rate selected such that said biasing member maintains said loofah support in said fully extended position relative to said handle absent application of less than a threshold external force to said loofah support.

12. The body scrubbing appliance of claim 1 wherein said biasing member comprises a compression spring having a predetermined spring rate selected such that said loofah support moves into said fully retracted position relative to said handle upon application of a predetermined maximum external force to said loofah support.

13. A body scrubbing appliance for operative attachment of a loofah having a loofah rope attached thereto for use by a person to scrub hard to access body parts, wherein the loofah rope may be of any of a plurality of different lengths, said body scrubbing appliance comprising:

a handle including a plurality of protrusions disposed on an outer surface thereof disposed on an outer surface of said handle, wherein each of said plurality of protrusions is configured to releasably attach at least a portion of the loofah rope having a different one of the plurality of lengths thereto, a channel formed within one end of said handle and accessible through an open top end thereof, a loofah support including a loofah holder dimensioned and configured to securely yet releasably maintain at least a portion of the loofah therein, said loofah support further comprising a support stem at least partially disposable through said open top end of said handle and into said channel, a biasing member disposed in said channel of said handle in an operative engagement with said support stem of said loofah support, a retention assembly configured to retain at least a portion of said support stem of said loofah support in said channel of said handle, said biasing member maintains said loofah support in a fully extended position relative to said handle when said biasing member is disposed in a substantially uncompressed state, and said biasing member allows said loofah support to move into a fully retracted position relative to said handle when said biasing member is disposed in a substantially compressed state.

14. The body scrubbing appliance of claim 13 wherein said loofah holder comprises a hand like configuration including a palm area having a plurality of digits extending therefrom.

15. The body scrubbing appliance of claim 14 wherein said palm areas of said loofah holder comprises a concave configuration.

16. The body scrubbing appliance of claim 14 wherein said loofah holder comprises at least one gap disposed between at least one adjacent pair of said digits, said gap dimensioned to receive at least a portion of the loofah rope there through, such that the loofah rope may be releasably attached to one of said plurality of protrusions on said handle.

17. The body scrubbing appliance of claim 14 wherein said loofah holder comprises a plurality of gaps, each of said plurality of gaps disposed between different adjacent pairs of said digits, each of said plurality of gaps dimensioned to receive at least a portion of the loofah rope there through, such that the loofah rope may be releasably attached to one of said plurality of protrusions on said handle.

18. The body scrubbing appliance of claim 13 wherein said biasing member comprises a compression spring having a predetermined spring rate selected such that said biasing member maintains said loofah support in said fully extended position relative to said handle absent application of less than a threshold external force to said loofah support.

19. The body scrubbing appliance of claim 13 wherein said biasing member comprises a compression spring having a predetermined spring rate selected such that said loofah support moves into said fully retracted position relative to said handle upon application of a predetermined maximum external force to said loofah support.

20. A body scrubbing appliance for operative attachment of a loofah having a loofah rope attached thereto for use by a person to scrub hard to access body parts, wherein the loofah rope may be of any of a plurality of different lengths, said body scrubbing appliance comprising:

a handle including a plurality of protrusions disposed on an outer surface thereof disposed on an outer surface of said handle, wherein each of said plurality of protrusions is configured to releasably attach at least a portion of the loofah rope having a different one of the plurality of lengths thereto, a channel formed within one end of said handle and accessible through an open top end thereof, a loofah support including a loofah holder dimensioned and configured to securely yet releasably maintain at least a portion of the loofah therein, said loofah holder comprises a hand like configuration including a palm area having a plurality of digits extending therefrom, said loofah holder comprises at least one gap disposed between at least one adjacent pair of said digits, said gap dimensioned to receive at least a portion of the loofah rope there through, such that the loofah rope may be releasably attached to said at least one protrusion on said handle, said loofah support further comprising a support stem at least partially disposable through said open top end of said handle and into said channel, a biasing member disposed in said channel of said handle in an operative engagement with said support stem of said loofah support, said biasing member comprises a compression spring having a predetermined spring rate selected such that said biasing member maintains said loofah support in a fully extended position relative to said handle absent application of less than a threshold external force to said loofah support, and said compression spring having a predetermined spring rate selected such that said loofah support moves into said fully retracted position relative to said handle upon application of a predetermined maximum external force to said loofah support.

* * * * *